United States Patent [19]

Sharma

[11] Patent Number: 4,782,346

[45] Date of Patent: Nov. 1, 1988

[54] FINLINE ANTENNAS

[75] Inventor: Arvind K. Sharma, Mercer County, N.J.

[73] Assignee: General Electric Company, Schenectady, N.Y.

[21] Appl. No.: 838,583

[22] Filed: Mar. 11, 1986

[51] Int. Cl.[4] ..... H01Q 1/38; H01Q 13/08

[52] U.S. Cl. ..... 343/795; 343/772

[58] Field of Search ..... 343/772, 786, 776, 767, 343/771, 768, 785, 783, 795, 807, 700 MS File; 333/21 A, 26, 247, 250

[56] References Cited

U.S. PATENT DOCUMENTS

| | | | |
|---|---|---|---|
| 3,710,258 | 1/1973 | Stenglein | 325/105 |
| 4,157,516 | 6/1979 | van de Grijp | 333/26 |
| 4,298,878 | 11/1981 | Dupressoir et al. | 343/772 |
| 4,370,659 | 1/1983 | Chu et al. | 343/772 |
| 4,425,549 | 1/1984 | Schwartz et al. | 333/247 |
| 4,500,887 | 2/1985 | Nester | 343/700 MS File |
| 4,502,053 | 2/1985 | Dupressoir et al. | 343/727 |
| 4,573,056 | 2/1986 | Dudome et al. | 343/795 |
| 4,673,897 | 6/1987 | Chua et al. | 333/21 A |

FOREIGN PATENT DOCUMENTS

| | | | |
|---|---|---|---|
| 2490025 | 3/1982 | France | 343/786 |
| 2519476 | 7/1983 | France | 343/772 |
| 221007 | 12/1984 | Japan | 343/700 MS File |

OTHER PUBLICATIONS

Article entitled "Vivaldi Antennas for Single Beam Integrated Receivers" by T. Thungren et al., published at the 12th European Microwave Conference.

Article entitled "The Vivaldi Aerial" by Gibson, published at the 9th European Microwave Conference.

Article entitled "A Novel MIC Slot-Line Antenna" by Prasad et al., published at the 9th European Microwave Conference.

Article entitled "Studies in Fin-Line Antenna Design for Imagaing Array Application" by Farr et al., (1985).

Article entitled "Optoelectronically Pulsed Slot-Line Antennas" by Heidemann et al., published Apr. 28, 1983, in Electronic Letters.

*Primary Examiner*—William L. Sikes

*Assistant Examiner*—Michael C. Wimer

*Attorney, Agent, or Firm*—Henry I. Steckler; James C. Davis, Jr.; Paul R. Webb, Jr.

[57] ABSTRACT

An antenna includes a truncated waveguide capable of supporting propagation of electromagnetic energy having an electric field component. A dielectric plate is located partially within and partially without the waveguide of the truncation, and is oriented parallel to the E field and the longitudinal axis of the waveguide. An upper half of one side of the dielectric plate bears a conductor pattern defining half of a finline. The lower half of the other side of the dielectric plate bears a second conductor pattern defining the other half of a finline. In the region without the waveguide, the finline diverges to form a radiating portion with high gain. In another embodiment, a finline is formed on both sides of the dielectric plate.

18 Claims, 20 Drawing Sheets

FINLINE ANTENNAS

This invention relates generally to antennas and more particularly to finline antennas drive from a hollow waveguide.

BACKGROUND OF THE INVENTION

Modern electromagnetic communication and remote sensing systems are using increasingly higher frequencies. High frequencies more readily accommodate the large bandwidths required by modern high data rate communications and such sensing arrangements as chirp radar. Also, at higher frequencies the physical size of an antenna required to produce a given amount of gain is smaller than at lower frequencies. Some high frequencies are particularly advantageous or disadvantageous because of the physical transmission properties of the atmosphere at the particular frequency. For example, communications are disadvantageous at 23 GHz because of the high path attenuation due to atmospheric water vapor and at 55 GHz because of oxygen molecule absorption. On the other hand, frequencies near 40 GHz are particularly advantageous for communication and radar purposes in regions subject to smoke and dust because of the relatively low attenuation of those frequencies.

When a high gain antenna array is required, it is advantageous if each antenna element of the array has physically small dimensions in the arraying directions. For example, if it is desired to have a rectangular planar array of radiating elements for radiating in a direction normal or orthogonal to the plane of the array, it is desirable if the physical dimensions of each antenna element in the plane of the array are small so that they may be closely stacked. For those situations in which an antenna array uses a large number of radiating elements, it is also desirable that the radiating elements be substantially identical so that the radiation patterns attributable to each radiating element are identical. A prior art antenna which is useful at millimeter wave frequencies such as 40 GHz and which has relatively small dimensions in a plane normal to the direction of radiation is the finline antenna. The finline antenna consists essentially of a pair of conductive coplanar fins defining a slot therebetween. The electromagnetic energy propagates in the direction of the length of the slot, constrained in the region about the slot and between the conductive fin elements. Such a structure has characteristics of both a transmission line and of an antenna. When the width of the slot lying between the conductive fins is the same from point to point along its length, the radiation therefrom is minimal, and the transmission line properties predominate. When the width of the slot changes from point to point along its length, radiation occurs in a travelling-wave mode. Th change in width of the slot may be a linear function of distance from an origin. A special case of a finline antenna having a slot width which changes in an exponential manner is known as a Vivaldi antenna. Those skilled in the art known that the receiving and radiating properties of antennas are reciprocal, so that discussion of an antenna in terms of its transmission properties defines its receiving properties, so no explicit discussion of the receiving properties is included herein. When a large number of antenna elements are used in an antenna array, it is desirable for each of the antenna elements to have the same radiating characteristics, in order to simplify the calculation and control of beam direction. When antenna elements are intended for high frequencies such as 40 GHz, they tend to be physically small. For example, at 40 GHz, one half wavelength is 0.147 in. (3.74 mm). The small size of the antenna elements and the element-to-element repeatability required for a high gain antenna array suggests that each finline be formed by printing the conductive pattern onto the side of a dielectric substrate by the methods known for printed circuit boards or for integrated circuit substrates.

It is desirable to maximize the gain from each finline antenna element.

SUMMARY OF THE INVENTION

An antenna includes a truncated hollow conductive waveguide having a longitudinal axis. A dielectric plate is located partially within the waveguide and partially without a waveguide at the truncation. The plane of the dielectric plate is parallel to an electric field component of the electromagnetic energy within the waveguide. A first conductive finline portion is affixed to one broad side of the dielectric plate and defines together with a second conductive finline portion affixed to the other broad side of the dielectric plate a first longitudinal slot having an axis parallel with the longitudinal axis of the waveguide. The width of the first slot increases within increasing distance from the port in the region without the waveguide to define a radiating portion having gain.

DESCRIPTION OF THE DRAWING

FIG. 7*c* is an elevation view of the antenna plate of FIG. 7*a.

FIG. 8 is a plot of measured gain as a function of flare angle for the antennas of FIGS. 1a, 3b and 7a;

FIG. 16b illustrates the electric field distribution within the ridged waveguide of FIG. 16a;

FIG. 18 is a cross-sectional view of another stacking arrangement for dielectric plates and printed patterns which may be used with the antenna of FIG. 17a;

FIG. 19b is an elevation view of the plate of FIG. 19a;

DESCRIPTION OF THE INVENTION

Figure 1A:
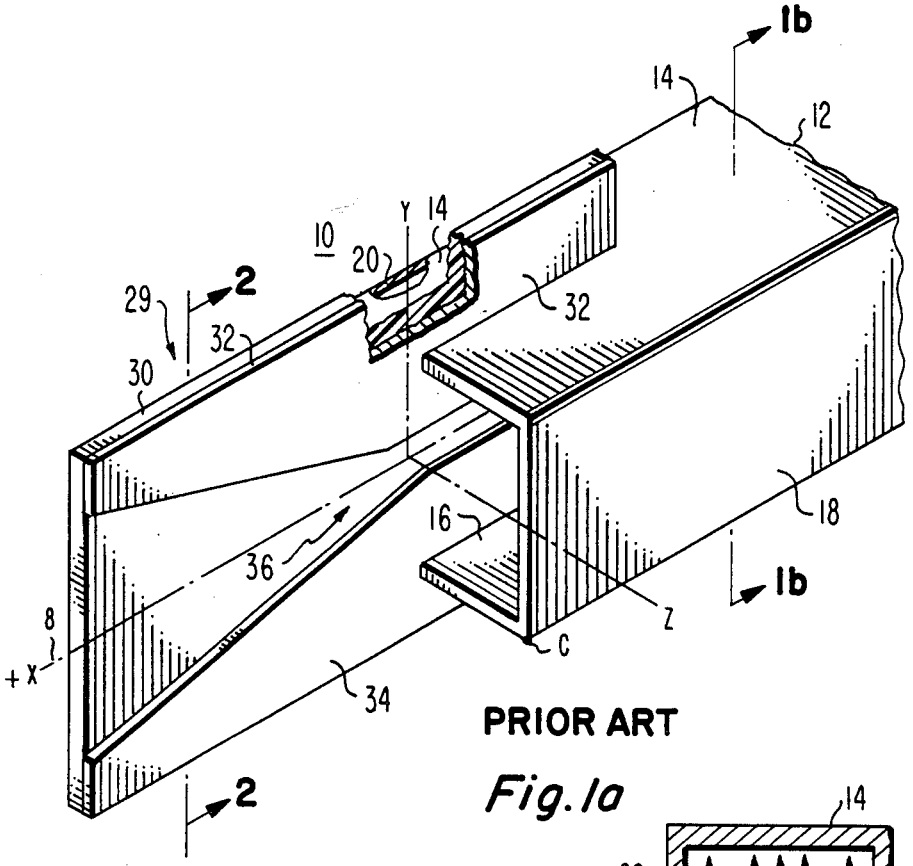
PRIOR ART Fig. 1a
FIG. 1*a* illustrates in cutaway perspective view a prior art finline antenna including a finline printed on a dielectric plate inserted partially into a hollow conductive waveguide.
Figure 1B:
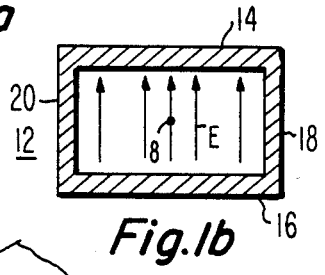
FIG. 1*b* is a cross-section taken through the waveguide, illustrating the electric filed configuration.
Figure 2:
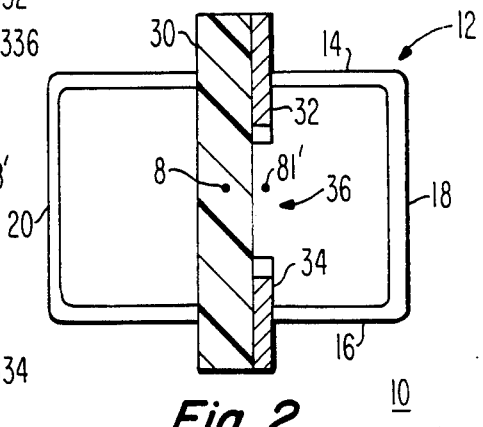
Fig. 2 PRIOR ART
FIG. 2 is a cross-section of the antenna of FIG. 1*a* in the finline region, illustrating the unilateral nature of the conductors.

FIG. 1a is a perspective view of a prior art antenna. In FIG. 1a, an antenna designated generally as 10 includes a hollow rectangular conductive waveguide 12 having first and second broad conductive walls 14 and 16, respectively, separated by narrow conductive walls 18 and 20. Waveguide 12 has a longitudinal axis 8 which is designated the X-axis. Waveguide 12 as illustrated is truncated at a plane parallel to a Y-Z plane and perpendicular to walls 14, 16, 18 and 20, and which passes through corner c. Waveguide 12 is adapted for propagating an electromagnetic field in a mode such as TE mode, having an electric field configuration such as that illustrated in the cross-sectional view of FIG. 1b, which has a maximum electric field density midway between narrow conductive walls 18 and 20, as suggested by the density of the arrows E representing the electric field lines. An antenna plate 29 in FIG. 1a is oriented parallel to waveguide walls 18 and 20, and is centered on longitudinal waveguide axis 8. Antenna plate 29 is located such that a portion is within waveguide 12, and a portion extends past the truncation and lies without waveguide 12. Antenna plate 29 includes a dielectric plate 30. Affixed to the near side of dielectric plate 30 is a first thin conductive plate 32, which may be formed in any known manner, as by electrodeposition onto dielectric plate 30. Symmetrically disposed relative to axis 8 and conductive plate 32 on the near side of dielectric plate 30 is a further thin conductive plate 34. The separation between conductive plates 32 and 34 defines a slot 36 which has substantially constant dimensions transverse to axis 8 within waveguide 12, thereby defining a finline transmission line having a characteristic impedance. The finline concentrates energy into the region between conductors 32 and 34. At a point near the waveguide truncation, the separation between conductive plates 32 and 34 increases, creating a region in which the characteristic impedance of the transmission line defined by the slot increases, and in which radiation takes place in a travelling wave mode. The radiation is directed generally in the direction of axis 8. FIG. 2 illustrates a cross-sectional view of an antenna 10 taken through antenna plate 29 at section lines 2—2. In FIG. 2, it can be seen that dielectric plate 30 is centered on axis 8. This slightly offsets slot 36 and its axis 81' away from longitudinal axis 8. As mentioned, conductive plates 32 and 34 are located on one side of dielectric plate 30. This configuration is hereinafter termed a unilateral configuration.

Figure 3A:
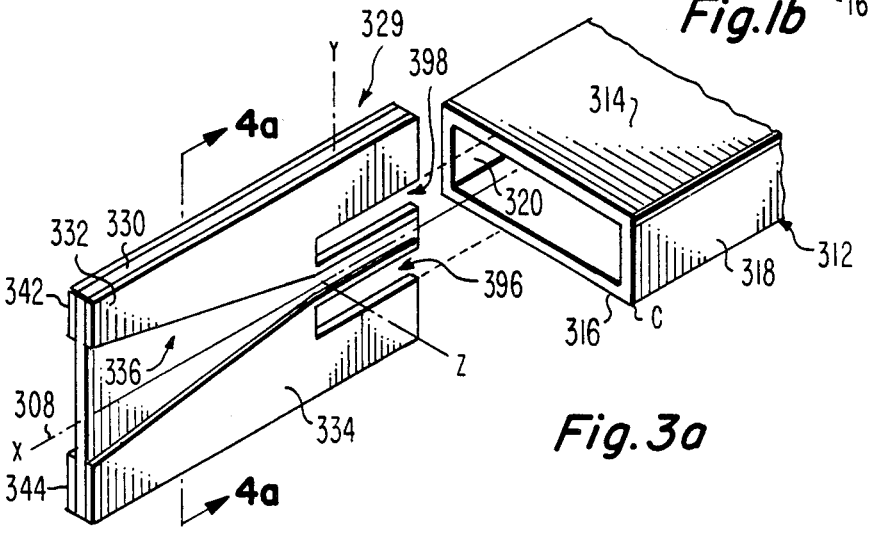
FIG. 3*a* is an exploded perspective view of an antenna according to the invention including a finline antenna plate portion and a hollow conductive waveguide.
Figure 3B:
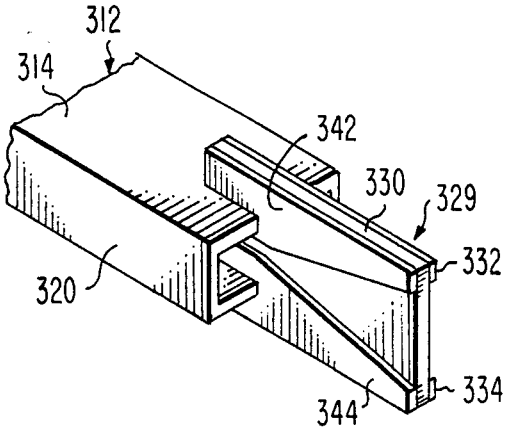
FIG. 3*b* is an assembled view.

FIG. 3a is an exploded view of an antenna according to the invention. In FIG. 3a, elements corresponding to those of FIG. 1a are designated by the same reference numeral in the 300 series. In FIG. 3, a waveguide 312 similar to waveguide 12 has a longitudinal axis 308, broad walls 314 and 316, and narrow walls 318 and 320. An antenna plate 329 includes a dielectric plate 330 which has formed on the near surface a pattern of conductors 332, 334 similar to pattern 32, 34 of FIG. 1a. Dielectric plate 330 may be formed from a material known as RT-Duroid, manufactured by Rogers Corporation, Chandler, Ariz., having a thickness of 0.254 mm and a relative dielectric constant ($\epsilon_r$) of 2.22. The pattern of conductors 332, 334 defines a slot 336 having transmission-line and radiating portions. Also illustrated in FIG. 3 are a pair of rectangular notches 396, 398 located at a distance from axis 308 by half the height of walls 318 and 320, and oriented so that when antenna plate 329 is assembled with waveguide 312 (FIG. 3b), slots 396 and 398 slip over the edges of waveguide walls 314 and 316 to provide support for plate 330.

Figure 4A:
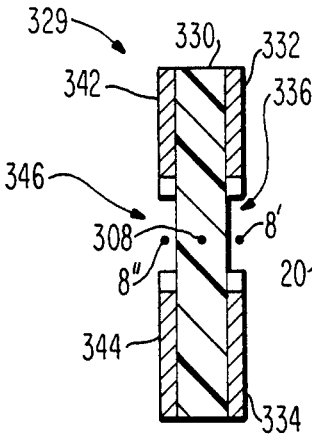
FIG. 4*a* is a cross-section of the antenna plate portion of the antenna of FIG. 3 illustrating the bilateral nature of the conductors.

In accordance with one aspect of the invention, dielectric plate 330 has affixed to the side away from the viewer (in FIG. 3a) further flat conductive portions 342, 344. Conductive portions 342 and 344 are more easily seen in FIG. 3b, which represents antenna 300 in assembled form. Conductive portions 342 and 344 are identical in shape and are registered with conductive portions 332, 334, respectively. FIG. 4a illustrates a cross section of antenna plate 329 of FIG. 3a taken along section lines 4a—4a. Conductor portions 342 and 344 define a further slot 346 having a transmission line portion in the region in which the slot dimensions remain constant and a radiating portion in the region in which the slot dimensions increase. The longitudinal axes 8' and 8'' of slots 336 and 346, respectively, are slightly offset from longitudinal axis 308, but are parallel thereto.

Figure 4B:
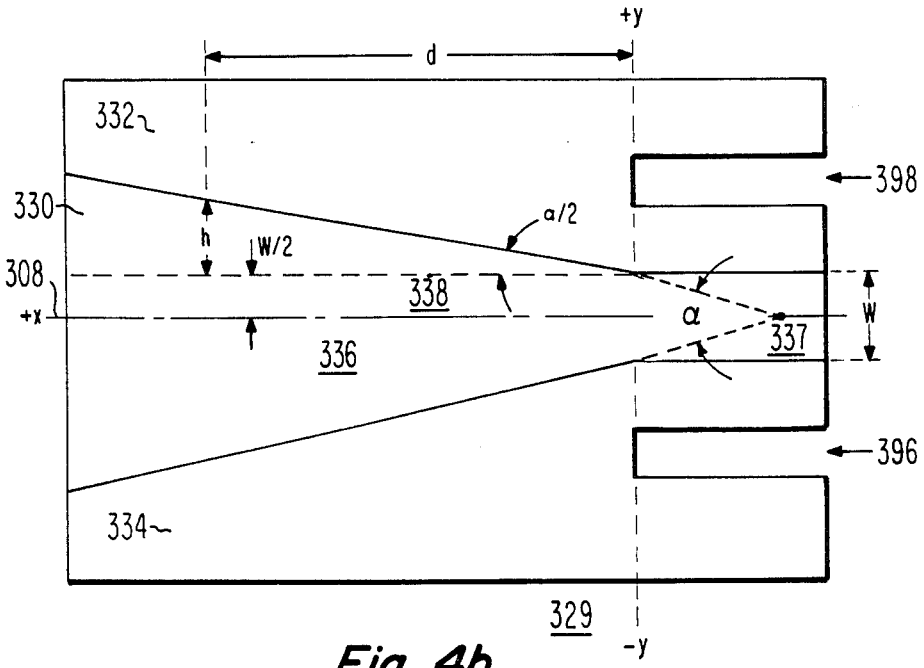
FIG. 4*b* is an elevation view of the broad side of the antenna plate portion of the arrangement of FIG. 3 illustrating the conductive pattern.

FIG. 4*b* is a side view of antenna plate 329. In FIG. 4*b*, a portion of slot 336 designated as 337 and having constant width w extends to the right of a Y-axis. As mentioned, this is the transmission line portion of slot 336. To the left of the Y-axis in FIG. 4*b* is a portion of slot 336 designated 338 in which the slot dimension increases with increasing distance from the Y-axis. As illustrated in FIG. 4*b*, portion 338 of slot 336 has dimensions which follow a linear taper. At any distance d from the Y-axis, the separation of a slot edge from X-axis 308 is the sum $h+(w/2)$, where $h=kd$, and k is a constant. This defines what amounts to a horn antenna with a flare angle of $\alpha$.

Conductor patterns 342 and 344 on the reverse side of antenna plate 329 are not visible in FIG. 4*b*, because these patterns are registered with the patterns of conductor portions 332 and 334.

When plate 329 is assembled to waveguide 312 (FIG. 3*b*) conductor portions 332, 334 and 342, 344 may be soldered by conductive solder to the adjacent surfaces of waveguide walls 314 and 316 in order to hold plate 329 and waveguide 312 in a fixed relationship. As an alternative, a conductive or nonconductive adhesive may be used. It is not absolutely necessary that conductor portions 332, 334, 342, 344 be electrically connected to the waveguide walls, because the large capacitance between the conductive portion and the waveguide walls is a low impedance at the frequencies of operation. When so assembled, antenna plate 329 has the origin (the intersection of the X and Y axes) of the flared portion of the conductor pattern substantially coincident with the truncated face of waveguide 312.

Figure 4C:
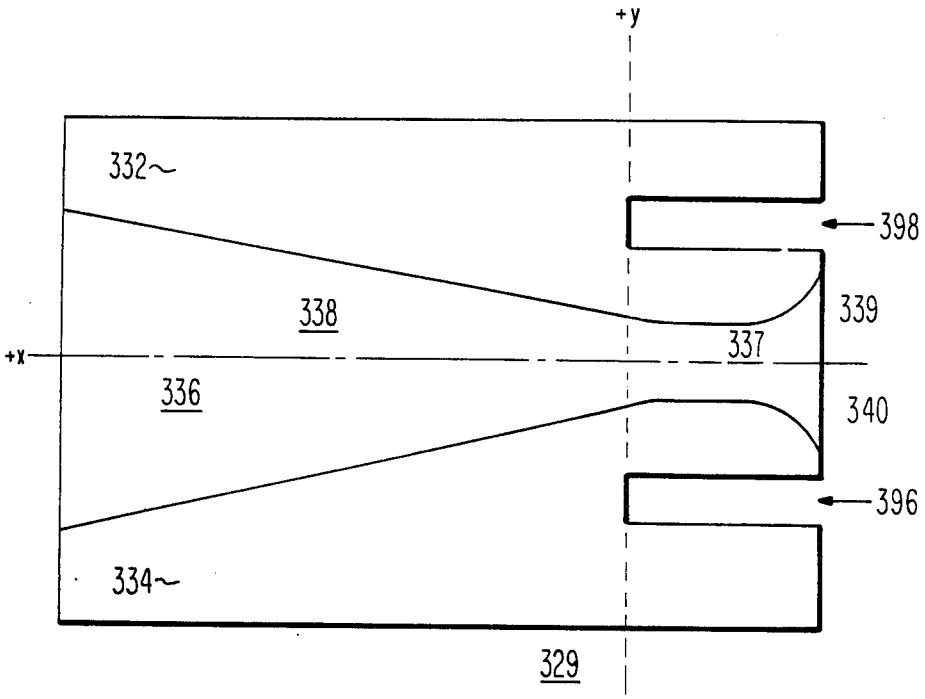
FIG. 4*c* is an elevation view of a plate similar to that of FIG. 4*b* having a conductive pattern defining a low reflection waveguide-to-finline transition.

As so far described, energy propagating through waveguide 312 towards the truncation is coupled into finline transmission slot or line 337, which couples the energy to radiating finline 338. The conductor pattern illustrated in FIG. 4*b* has a characteristic impedance associated with transmission line slot portion 337 which may not match the characteristic impedance of waveguide 312 from which it is fed. As is well known in the art, this may result in reflections, which reduces the energy coupled into the antenna. This problem may be ameliorated by providing a flared transition region between transmission line portion 337 and waveguide 312, as illustrated in FIG. 4*c* by curved edges 339 and 340 near the right edge of plate 329. This portion does not radiate, because the tapered transition lies between a pair of transmission lines (waveguide and the radiating portion 338 of the finline).

Figure 5A:
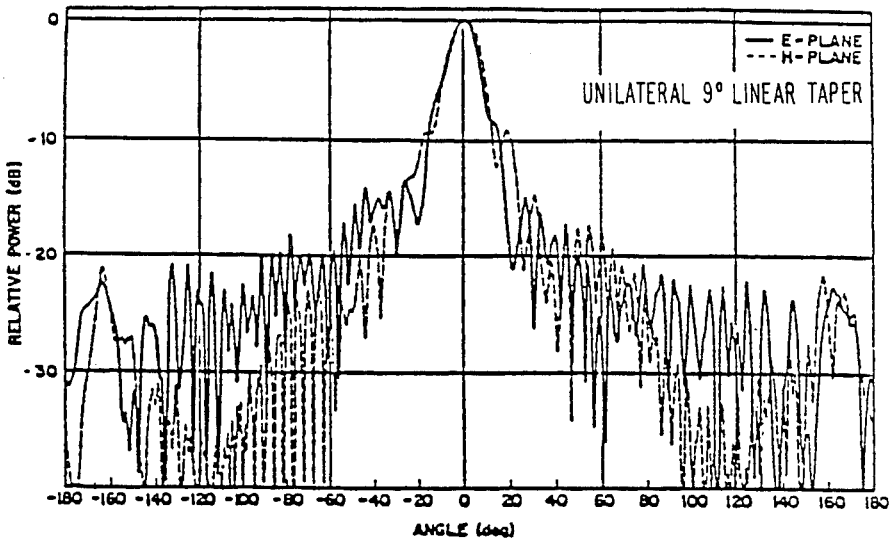
FIG. 5*a* illustrates the antenna radiation pattern of the antenna of FIG. 1*a* for reference.
Figure 5B:
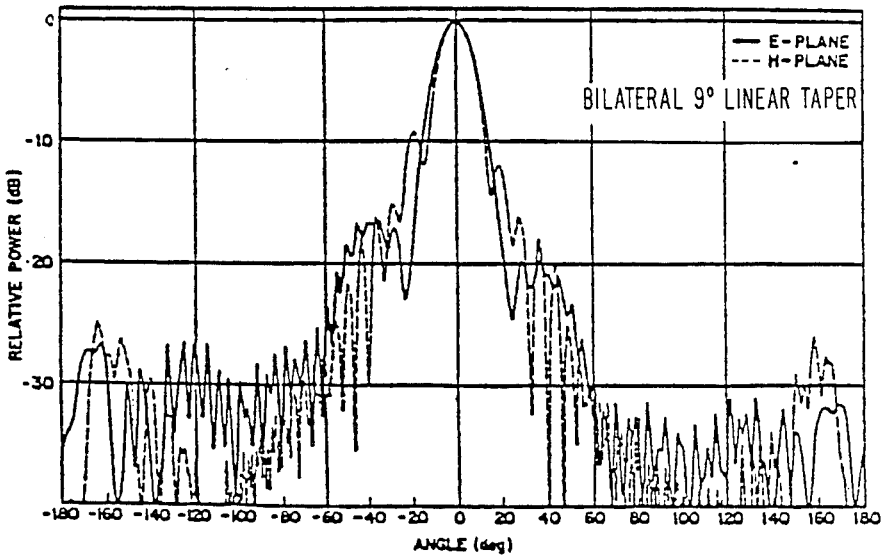
FIG. 5*b* illustrates the radiation pattern of the antenna of FIG. 3*b;*
Figure 6A:
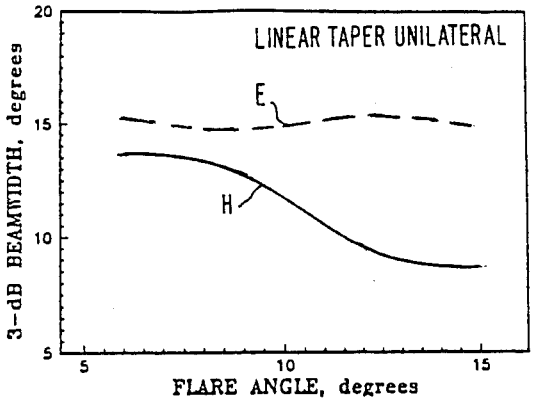
FIG. 6*a* is a plot of 3 dB beamwidth as a function of antenna flare angle for the prior art antenna of FIG. 1*a,* and FIG. 6*b* is a corresponding plot for the antenna of FIG. 3*b;*
Figure 6B:
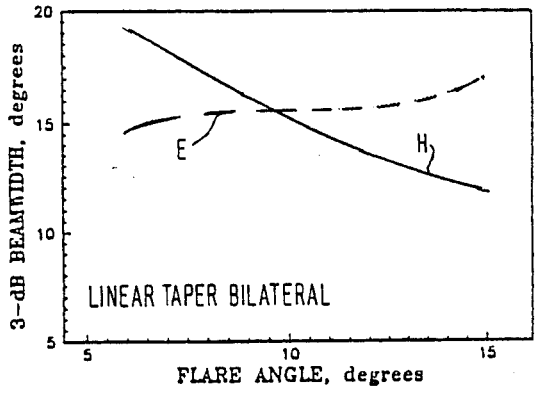

FIG. 5*a* illustrates the E and H plane radiation pattern at 44 GHz of the prior art unilateral antenna of FIG. 1*a*, and FIG. 5*b* is a like radiation pattern for the bilateral antenna according to the invention illustrated in FIG. 3*b*, both with a linear taper having an included or flare angle $\alpha=9°$. FIG. 6*a* plots the 3 dB beamwidth of the prior art unilateral antenna of FIG. 1 at 44 GHz as a function of flare angle $\alpha$, and FIG. 6*b* is a like plot for the bilateral antenna of FIG. 3Ii b. As illustrated, the unilateral antenna according to the prior art has a generally smaller 3 dB beamwidth than the bilateral antenna. For example, for $\alpha=9°$ the E and H plane patterns have about 12° and 15° 3 dB beamwidth for the unilateral antenna, whereas for the bilateral antenna the E and H plane beamwidths are both about 15°. Based solely upon beamwidth consideration, one would expect the prior art antenna to have greater gain than the antenna according to the invention.

Figure 7A:
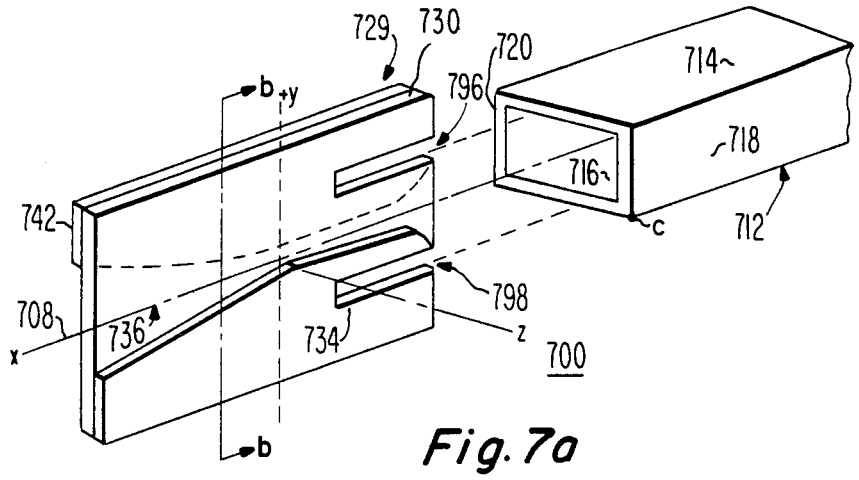
FIG. 7*a* is an exploded perspective view of another embodiment of the invention including an antenna plate and a waveguide.
Figure 7B:
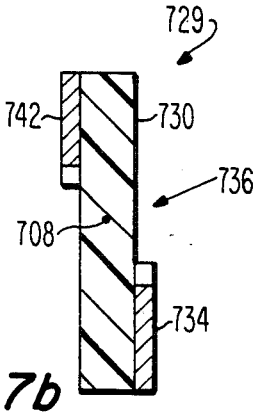
FIG. 7*b* is a cross-sectional view of the antenna plate portion of the antenna of FIG. 7*a* illustrating the antipodal nature of the conductor arrangement.
Figure 7C:
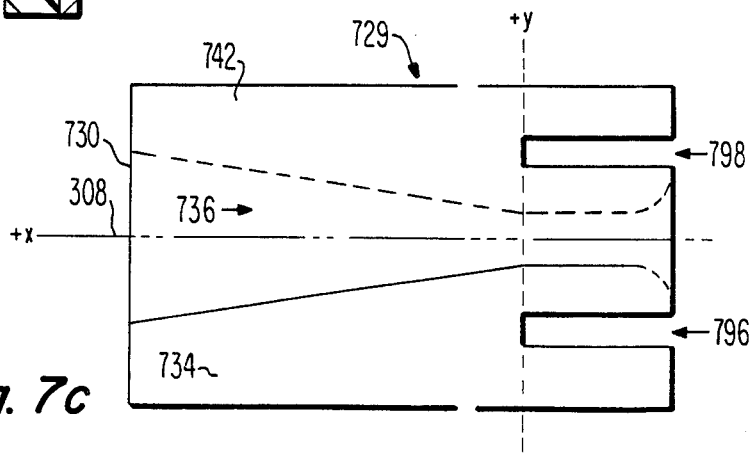

FIG. 7*a* is an exploded view of an antenna according to the invention. In FIG. 7*a*, elements corresponding to those of FIG. 3*a* are designated by the same reference numeral in the 700 series rather than in the 300 series. In FIG. 7*a*, an antenna 700 includes an elongated waveguide 712 having broad walls 714, 716 separated by narrow walls 718 and 720. Waveguide 712 is truncated at a plane orthogonal to its longitudinal axis 708 and parallel to the Y-Z plane. The plane of truncation passes through corner point c. Antenna 700 also includes an antenna plate 729 including a dielectric plate 730 having notches 796 and 798 which are dimensioned to fit snugly over walls 714 and 716, respectively. The near side of dielectric plate 730 bears a flat printed conductor 734 which lies entirely below the X-Z plane. The far side of plate 730 bears a further flat conductor 742 which lies in the region entirely above the X-Z plane. FIG. 7*b* shows a cross-sectional view taken through antenna plate 729 at section line b—b. As illustrated in FIG. 7*b*, conductor patterns 734 and 742 together define a skewed or off-centered finline. FIG. 7*c* is a side or elevation view of antenna plate 729 illustrating the conductor pattern. It can be seen that the conductor pattern is very similar in side view to the conductor pattern illustrated in FIG. 4*c*, the only difference being that the conductor pattern, rather than being on both sides of the dielectric plate 730, has one-half appearing on each side, as described. This configuration is hereinbelow termed an antipodal configuration.

Figure 7D:
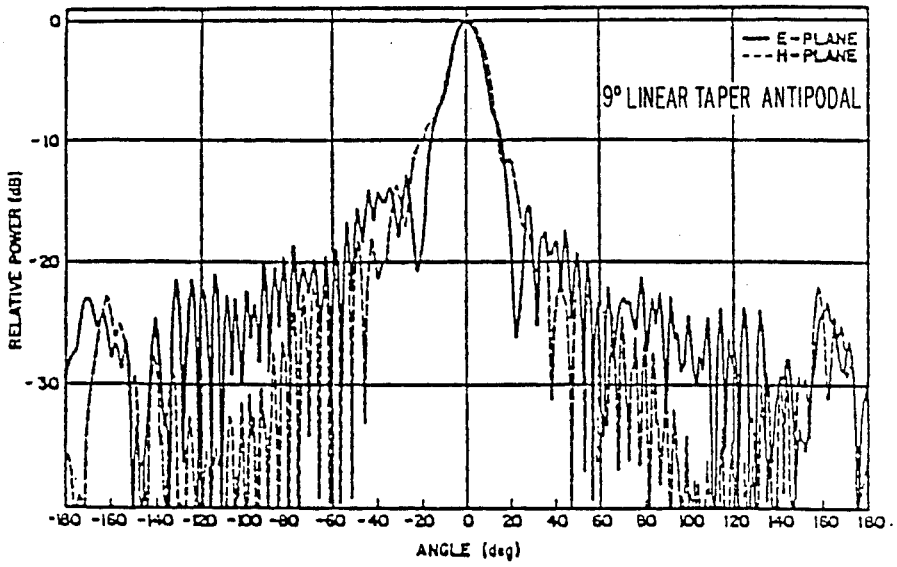
* FIG. 7*d* illustrates the radiation pattern of the antenna of FIG. 7*a,* and FIG. 7*e* is a plot of beamwidth as a function of flare angle for the antenna of FIG. 7*a;*
Figure 7E:
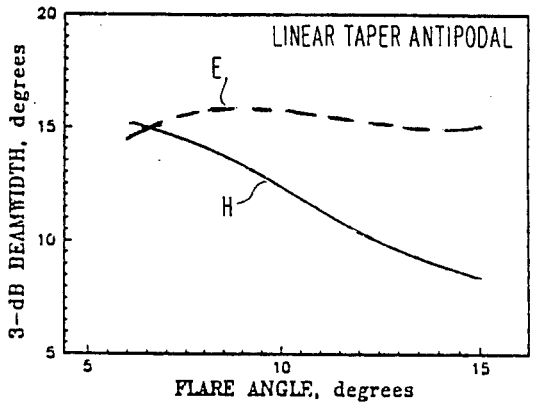

FIG. 7*d* illustrates E and H plane radiation patterns at 44 GHz for an antipodal antenna such as that illustrated in FIG. 7*a* having a 9° linear taper. FIG. 7*e* is a plot of 3 dB beamwidth of the radiation patterns of antennas such as those of FIG. 7*a* with various flare angles. Comparison of FIG. 7*e* with FIG. 6*a* shows that the 3 dB beamwidths of the unilateral and antipodal antennas are approximately the same, and therefore it would be expected that their gains would be approximately equal.

Figure 8:
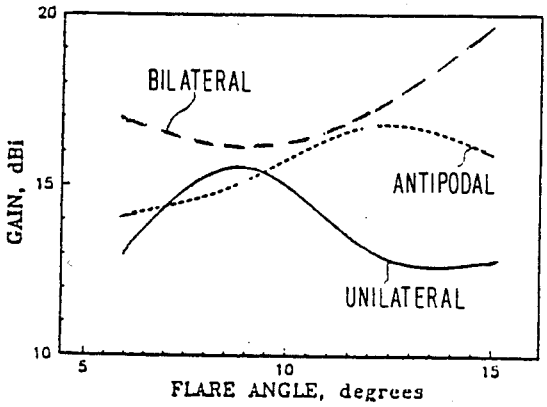

FIG. 8 is a plot of measured gain with respect to an isotropic source for the prior art unilateral antenna, and for bilateral and antipodal antennas according to the invention, all having a linear flare and fixed length, as a function of flare angle $\alpha$. As illustrated in FIG. 8, for many flare angles the antipodal antenna has substantially more gain than the unilateral antenna, and the bilateral antenna has more gain than the unilateral antenna at all flare angles. This result is unexpected, and the reasons therefor are not clear.

Figure 9A:
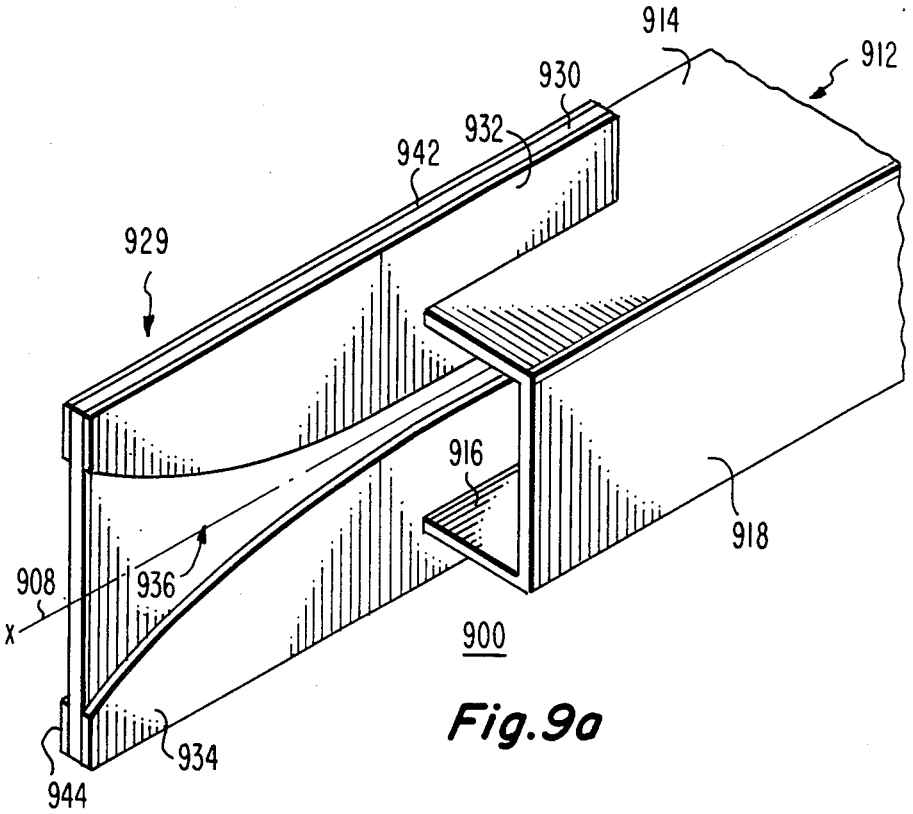
FIG. 9a is a perspective view of an antenna according to the invention having a nonlinear or exponential flare.
Figure 9B:
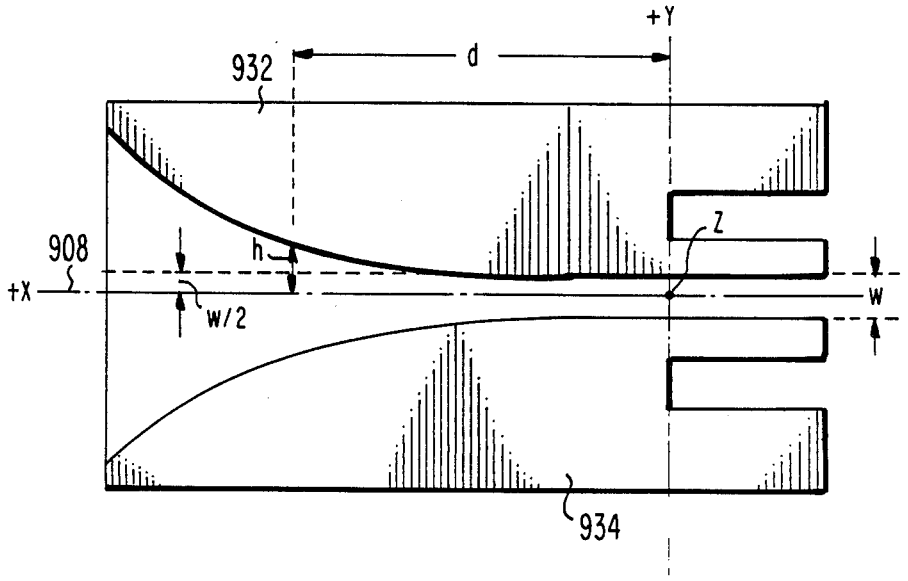
FIG. 9b is a view of the broad side of the antenna plate and its printed pattern.
Figure 10A:
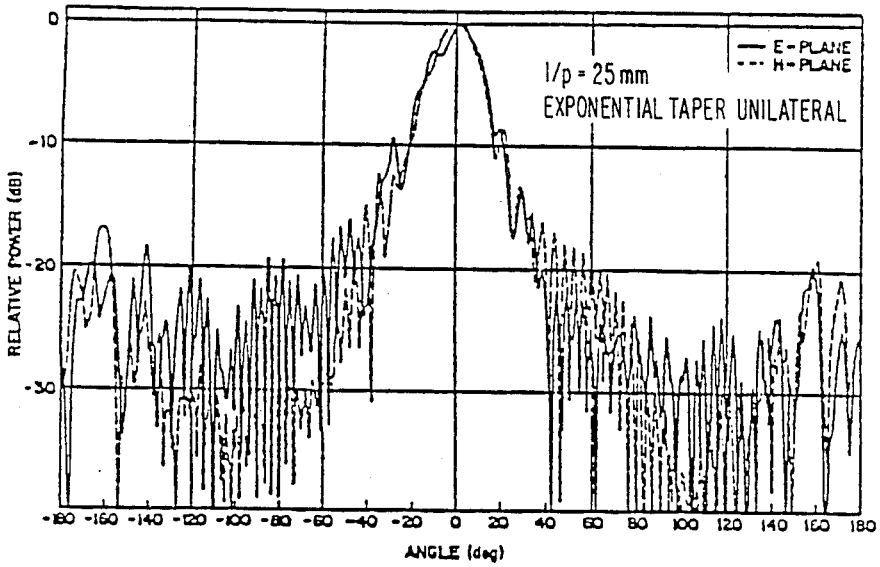
FIG. 10a is a plot illustrating the radiation pattern of a prior art antenna having a nonlinear flare.
Figure 10B:
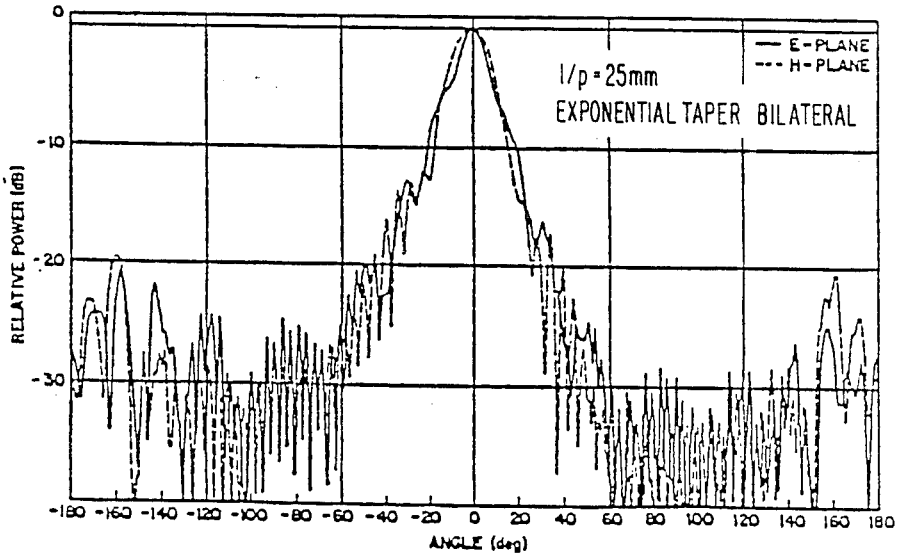
FIG. 10b is a corresponding plot for an antenna according to the invention having the same nonlinear flare.

FIG. 9*a* is an assembled view of a bilateral antenna 900 according to the invention. In FIG. 9, elements corresponding to those of FIG. 3*a* are designated by the same reference numeral in the 900 series, rather than in the 300 series. The only difference between antenna 900 of FIG. 9*a* and the antenna 300 of FIG. 3*a* lies in the defining curve for the radiating slot, which is exponential rather than linear. FIG. 9*b* is a side view of antenna plate 929 of FIG. 9*a*, illustrating the curvature of the facing edges of conductive portions 932 and 934 in the flared radiating region. As in the case of antenna 300, the edges of conductors 932 and 934 defining slot 936 are mirror images of each other about the X-axis. At the intersection of the Y and the Z axes, the slot width is w, and half the slot width is w/2. The equation defining the edge of conductive plate 932 is $$h=(w/2)e^{pd} \quad (1)$$

where h is one-half the slot dimension at a position d along the X-axis measured from the Y-axis, and p is a constant having dimensions of reciprocal distance. FIG. 10*a* represents a radiation pattern in the E and H planes of a prior art unilateral antenna having an exponential taper defined by 1/p=25 mm. FIG. 10*b* represents a radiation pattern of a bilateral antenna according to the invention also having an exponential taper and 1/p=25 mm.

Figure 11A:
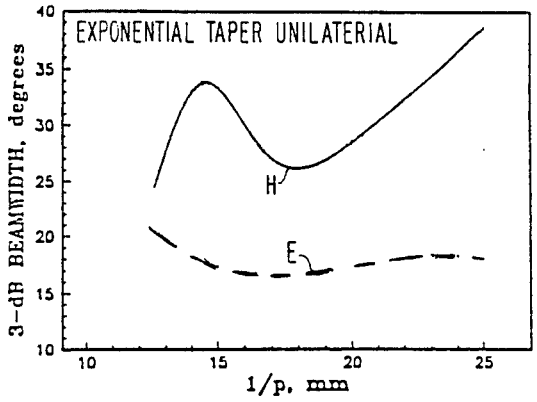
FIGS. 11a and 11b are plots of beamwidth as a function of expansion for prior art antennas and antennas according to the invention having exponential flares.
Figure 11B:
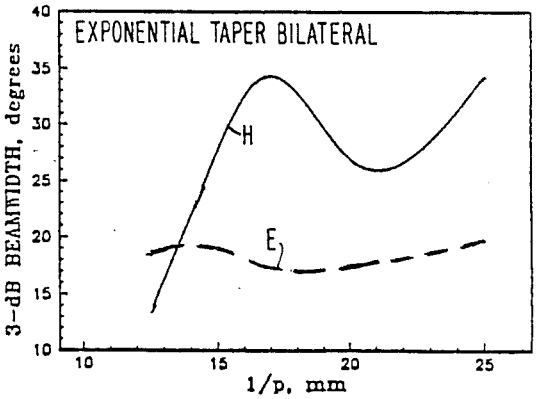

FIG. 11*a* is a plot of 3 dB beamwidth of unilateral antennas with exponential flares according to the prior art as a function of expansion factor 1/p. FIG. 11*b* is a corresponding plot for the bilateral antenna of FIG. 9*a*. As illustrated, the curves of FIG. 11*b* have a crossover point representing equal E and H plane beamwidths at 1/p=approximately 13.5 mm. At some expansion factors, the beamwidth of the prior art antenna is less, and at other expansion factors, the beamwidth of the bilateral antenna is the lesser.

Figure 12A:
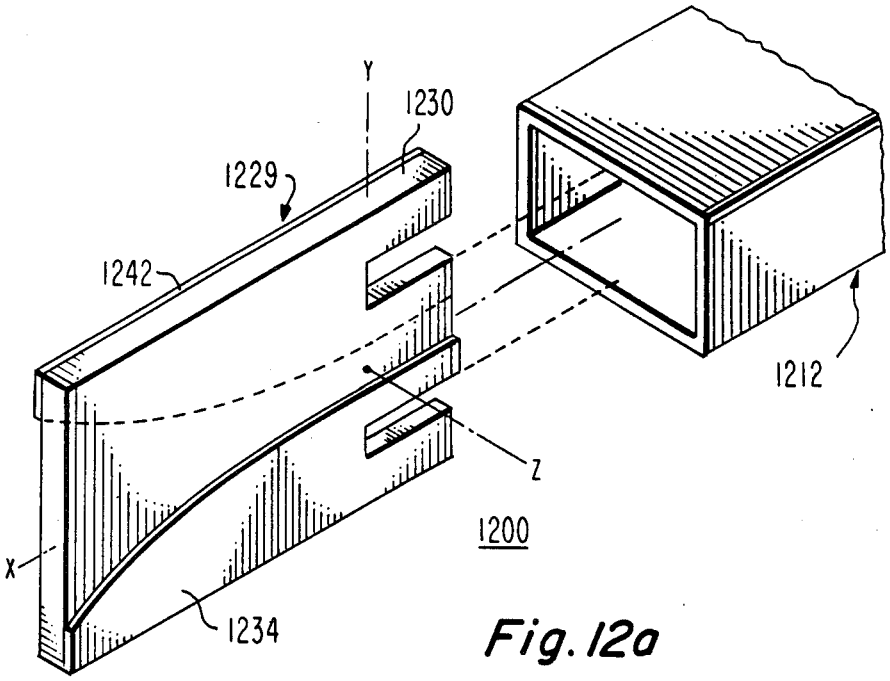
FIG. 12a is an exploded perspective view of an antenna according to the invention having an antipodal conductor configuration.
Figure 12B:
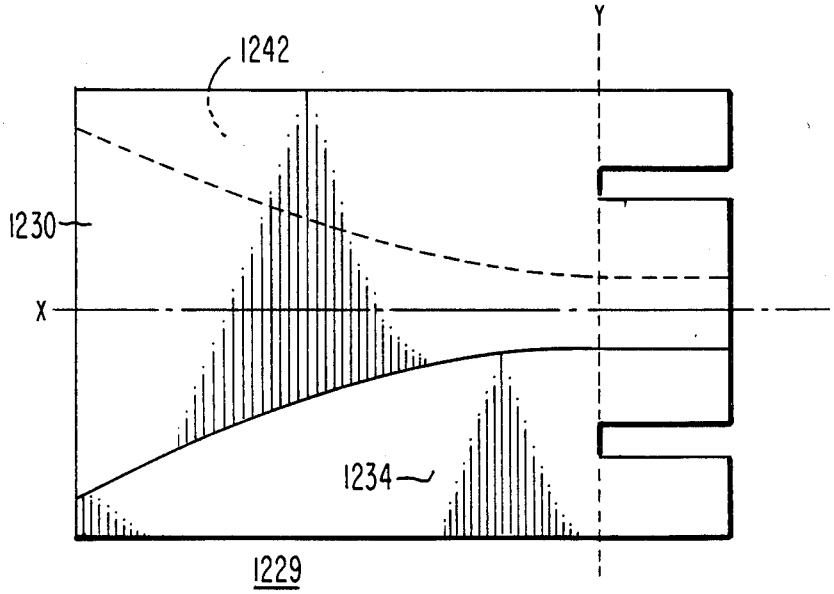
FIG. 12b is an elevation view of its antenna plate and printed conductive pattern.

FIG. 12*a* is an exploded view of an antipodal antenna 1200 according to the invention, including a truncated waveguide portion 1212 and an antenna plate 1229 having a dielectric plate 1230. On the near side of dielectric plate 1230 and lying entirely below the X-Z plane is a conductor portion 1234, and on the far side of dielectric plate 1230 and lying entirely above the X-Z plane is a further conductor portion 1242. As in the case of antenna 700 of FIG. 7*a*, the antipodally oriented conductors 1234 and 1242 together define a skewed finline. In this case, however, the slot dimensions increase exponentially with distance away from the Y-axis outside the waveguide. FIG. 12*b* is an elevation view of antenna plate 1229 showing the curvature of the facing edges of conductor portions 1234, 1242. The defining equation for the curve is equation (1).

Figure 13A:
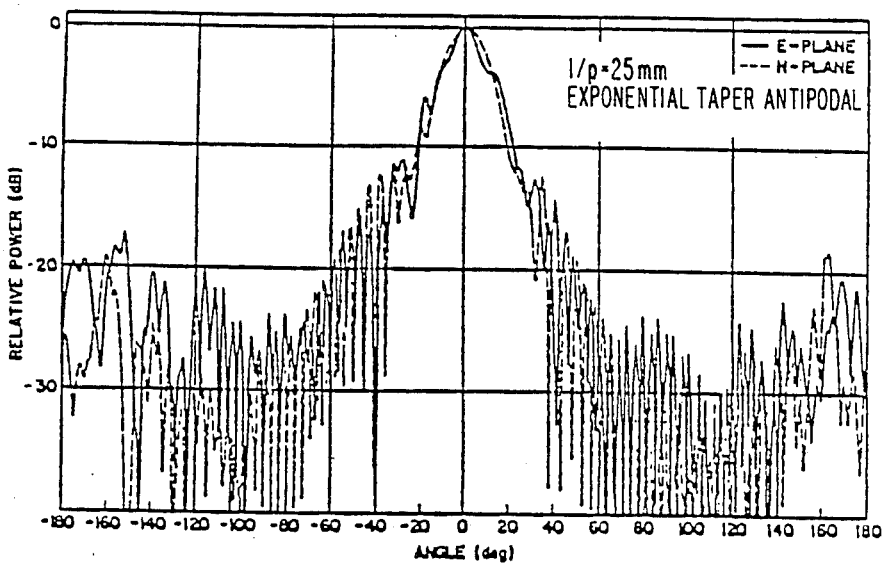
FIG. 13a illustrates the radiation pattern of the antenna of FIG. 12a, and FIG. 13b is a plot of its beamwidth versus expansion.
Figure 13B:
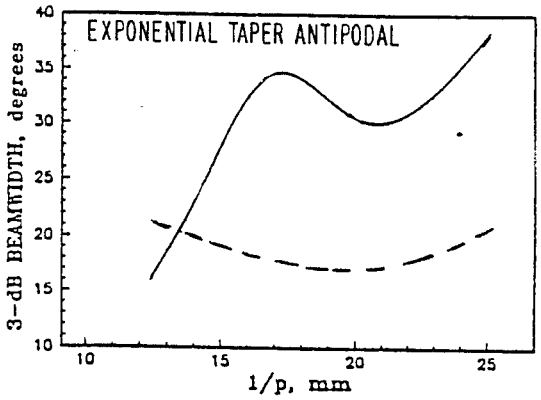
Figure 14:
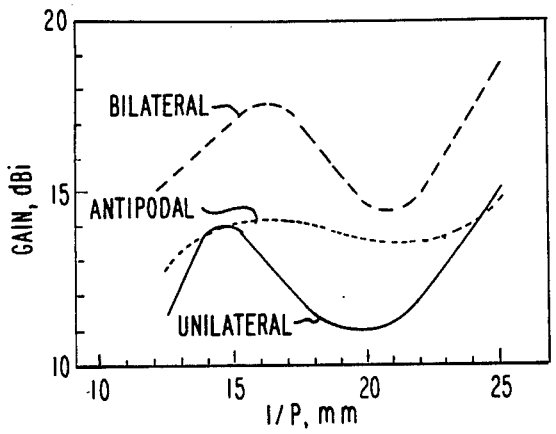
FIG. 14 is a plot of the gain of a prior art unilateral antenna, the antenna of FIG. 9a and the antenna of FIG. 12a having exponential flares.

FIG. 13*a* presents the radiation pattern at 44 GHz of antenna 1200 having a conductor configuration defined by an expansion ratio of 1/p=25 mm. FIG. 13*b* is a plot of 3 dB beamwidth for antennas similar to antenna 1200 for various expansion ratios. Comparison with FIG. 11*a* shows disparities in H-plane beamwidths as a function of expansion factor. FIG. 14 is a plot of antenna gain relative to an isotopic source as a function of expansion ratio 1/p for prior art unilateral antennas, and for bilateral and antipodal antennas according to the invention. As illustrated therein, for all expansion ratios the antipodal antenna has gain substantially equal to or higher than the prior art unilateral antenna, and the bilateral antenna has higher gain for all values of expansion factor. As in the case of the linear taper antennas, this result is unexpected.

Figure 15A:
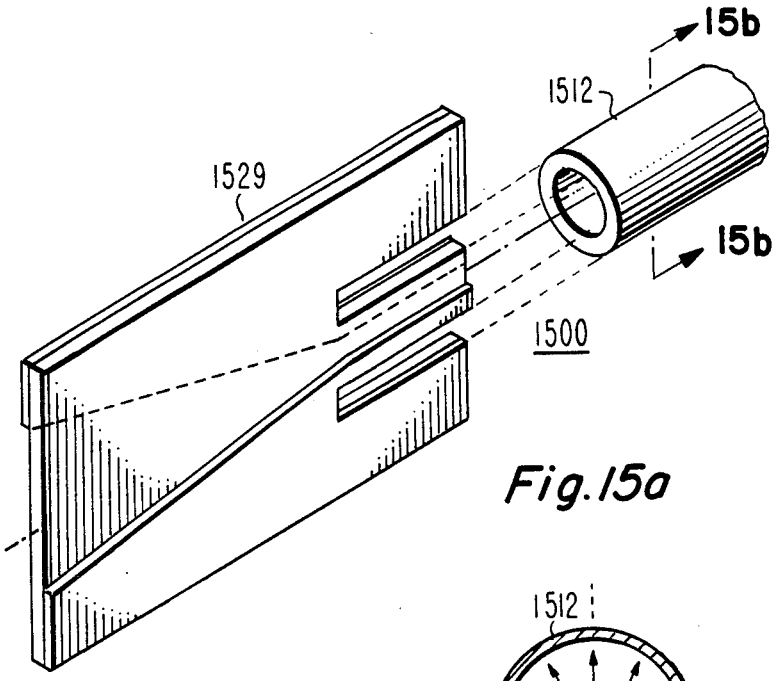
FIG. 15a illustrates an antenna according to the invention driven from a circular waveguide.
Figure 15B:
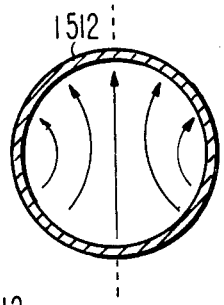
FIG. 15b illustrates the electric field configuration within the circular waveguide.
Figure 16A:
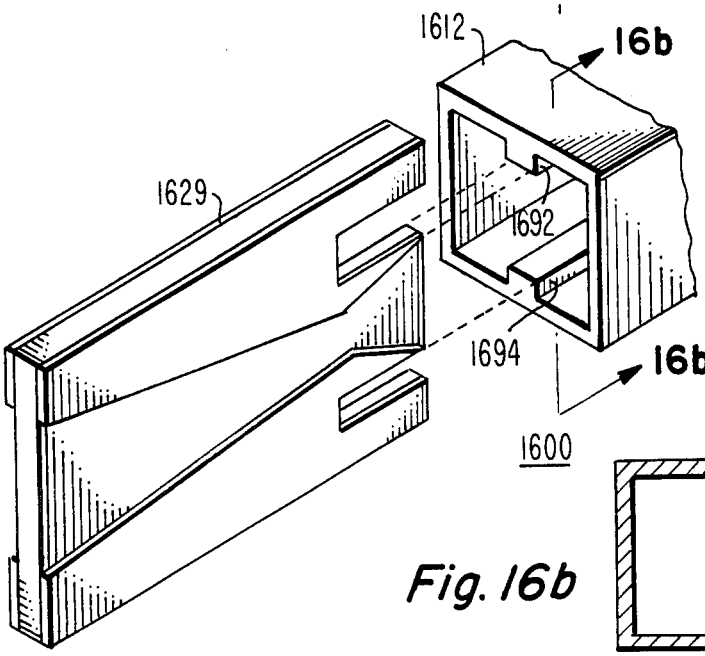
FIG. 16a illustrates an antenna according to the invention using ridged waveguide.
Figure 16B:
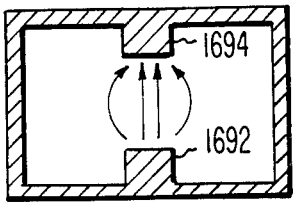

FIG. 15*a* illustrates an antenna 1500 including a truncated circular waveguide 1512 and an antenna plate 1529 in an antipodal radiating configuration. FIG. 15*b* is a cross-section of waveguide 1512 at section lines b—b illustrating the electric field configuration within the waveguide. Plate 1529 is oriented parallel to the main portion of the electric field. FIG. 16*a* illustrates an exploded view of an antenna 1600 including a ridged waveguide 1612 and an antenna plate 1629 having a bilateral configuration. FIG. 16*b* is a cross-section of waveguide 1612 at section lines b—b illustrating the concentration of the electric field lines between ridges 1692 and 1694. Antenna plate 1629 is oriented parallel with the principal portion of the electric field lines or in-line with ridges 1692 and 1694. The conductive portions of antenna plate 1629 are electrically connected to the adjacent portions of the ridges.

Figure 17A:
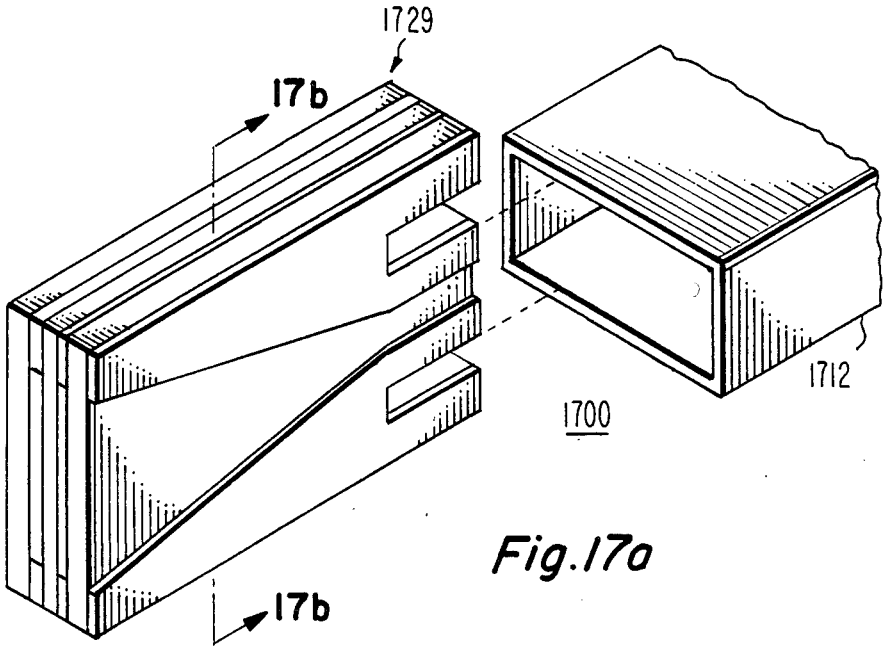
FIG. 17a illustrates an antenna according to the invention including a stack of alternating dielectric plates and conductive patterns.
Figure 17B:
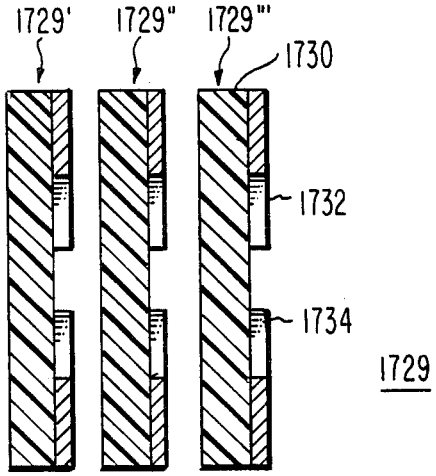
FIG. 17b is a cross-sectional view of the plates and conductive patterns.

FIG. 17*a* illustrates in exploded view an antenna 1700 including a rectangular waveguide 1712 and a composite antenna plate 1729. FIG. 17*b* is a cross-section of composite antenna plate 1729 taken along section line b—b. In FIG. 17*b*, it can be seen that composite antenna plate 1729 is made up of three separate plates 1729', 1729'' and 1729'''. These three plates are shown slightly separated to enhance understanding. Antenna plate 1729'' is typical, and includes a dielectric plate portion 1730 and upper and lower conductor portions 1732 and 1734, respectively. While each individual antenna plate such as 1729''' is itself unilateral, their combination is multilateral. It is believed that such a configuration provides higher gain than prior art unilateral arrangements.

Figure 18:
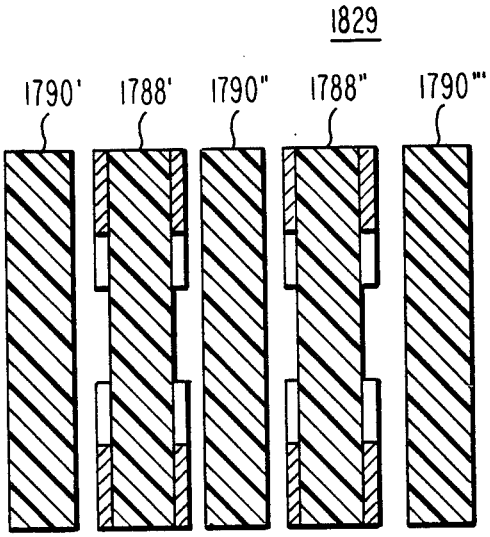

FIG. 18 illustrates in cross section another arrangement for generating a composite antenna plate such an antenna plate 1729 of FIG. 17*a*. In FIG. 18, a composite antenna plate 1829 is made up of alternating dielectric and bilateral antenna plate elements. The dielectric plates are 1790', 1790'' and 1790'''; and the bilateral plates are 1788' and 1788''.

Figure 19A:
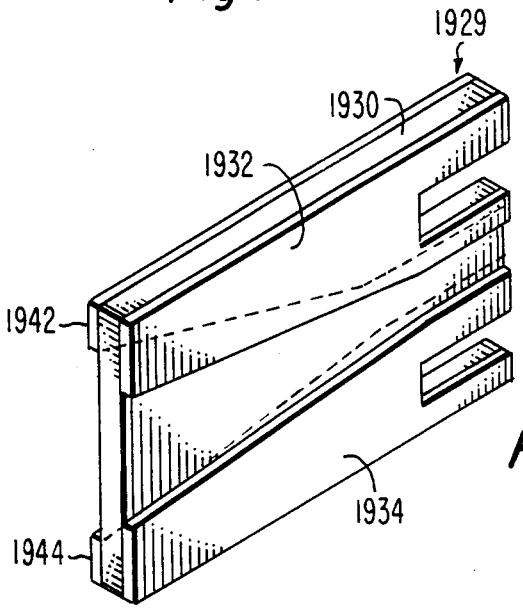
FIG. 19a illustrates a dielectric plate and conductive pattern according to the invention in which unregistered or different patterns occur on opposite sides of the dielectric plate.
Figure 19B:
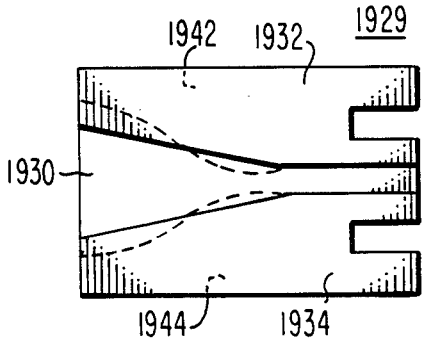

FIG. 19*a* is a perspective view of a bilateral antenna plate 1929 including a dielectric plate 1930, a conductor pattern including conductor portions 1932, 1934 on the near side of dielectric plate 1930, and another conductor pattern including conductor portions 1942, 1944 on the far side of dielectric plate 1930. FIG. 19*b* is an elevation view of antenna plate 1929 showing the differences between the conductor patterns on the obverse (near) and reverse sides of dielectric plate 1930. As illustrated, the conductor pattern on the obverse defines a linear slot, and the pattern on the reverse defines a exponentially tapered slot. Such a configuration, or a configuration (not illustrated) in which identical patterns appear on each side but are unregistered, may provide cross polarization components of the radiated field.

Figure 20B:
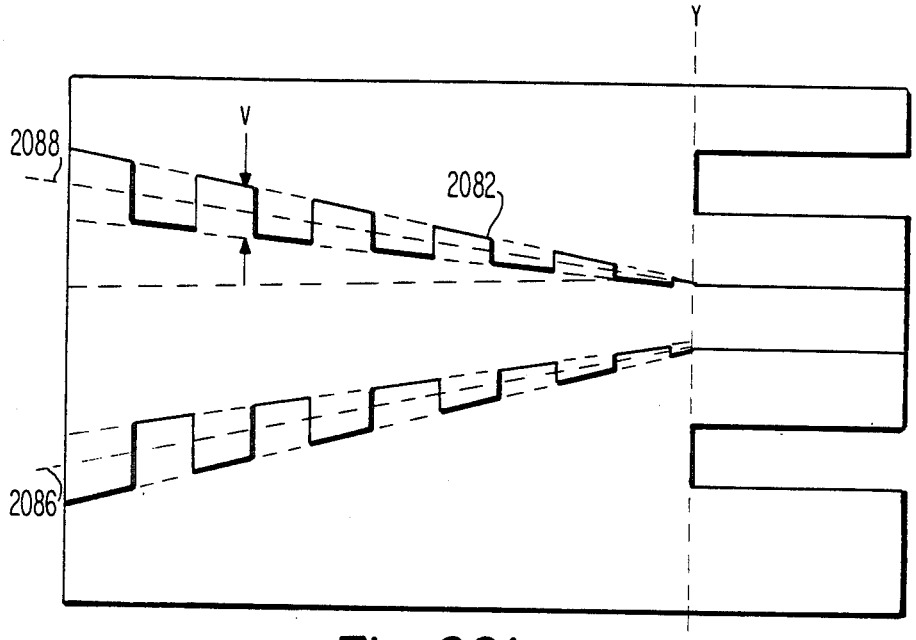
FIG. 20b illustrates serrations which change in size as a function of position.
Figure 20A:
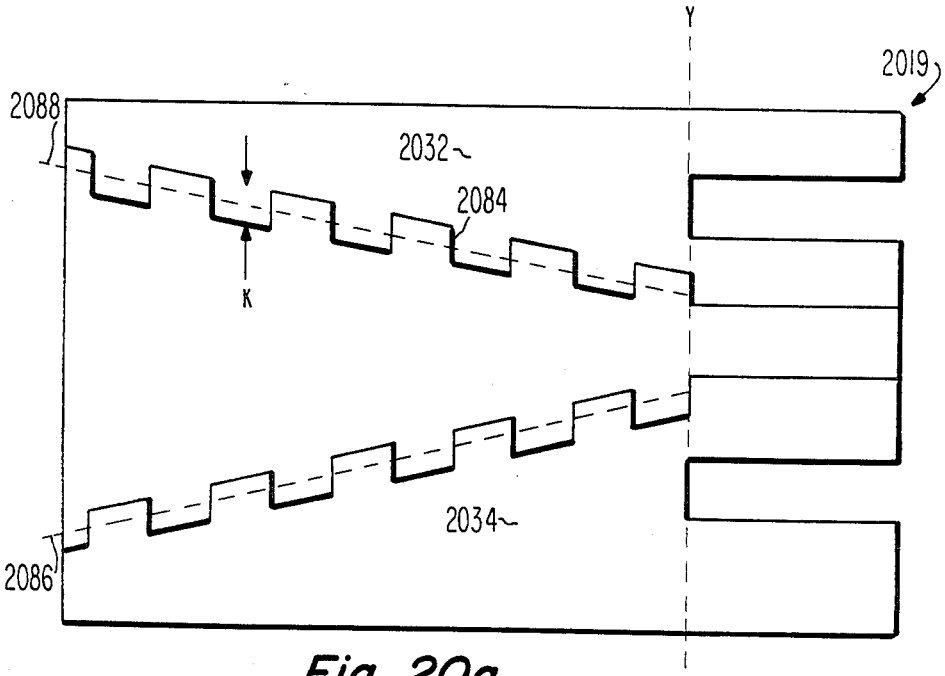
FIG. 20a is a side view of a dielectric plate with a conductor pattern having an average linear flare and fixed-size serrations.

FIG. 20*a* is a elevation view of an antenna plate 2019 having a conductor pattern 2032, 2034 on both obverse and reverse sides. In order to enhance radiation, a phase delay between the radiated and guided fields is introduced by serrations or notches along a conductor edge. In FIG. 20*a*, the average spacing between conductors 2032 and 2034 increases within increasing distance to the left from the Y-axis, as illustrated by dashed lines 2086, 2088, which represent the average conductor position. The serrations, one of which is designated as 2084, have constant height illustrated as dimension K over the entire diverging conductor portion to the left of axis Y. FIG. 20*b* is similar to FIG. 20*a*, except that the height of the serrations 2082 is variable as a function of distance to the left of the Y axis, whereby the dimension V is variable. Dimension V may be a constant multiplied by the distance from the Y-axis, or may increase exponentially. Such arrangements tend to enhance radiation.

Figure 21:
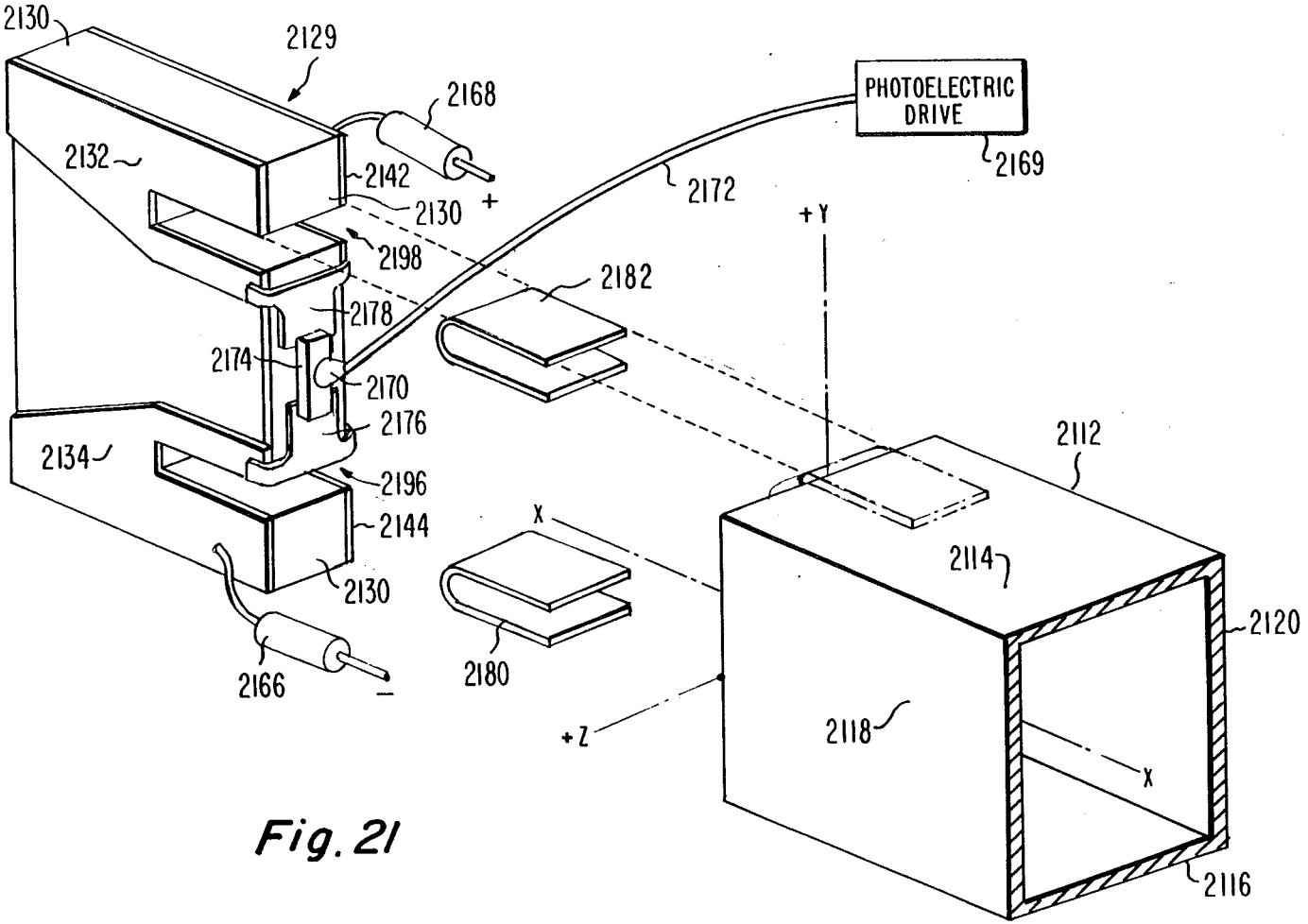
FIG. 21 is an exploded view of an antenna according to the invention in conjunction with an integral pulse generator.

FIG. 21 is an exploded view of a bilateral antenna as described hereinbefore integrated with a pulse generator. In FIG. 21, a rectangular waveguide 2112 is truncated at the Y-Z plane. Waveguide 2112 has broad walls 2114, 2116 and narrow walls 2118, 2120. An antenna plate 2129 includes a dielectric plate 2130 and a bilateral conductor configuration including conductors 2132, 2134 on the near side and 2142, 2144 on the far side. Notches 2196 and 2198 are cut into that portion of antenna plate 2129 facing waveguide 2112 and are dimensioned to accommodate the thickness of broad walls 2114, 2116 and insulators 2180 and 2182. Insulators 2180 and 2182 are thin Mylar insulators which are folded to insulate conductors 2132 and 2134, 2142 and 2142 from contact with the walls of waveguide 2112 when the antenna is assembled. A metallic bridging element 2178 connects together conductor portions 2132 and 2142 at the rear of antenna plate 2129. Similarly, a conductive member 2176 interconnects conductor portions 2134, 2144. Members 2175 and 2178 include flat portions which provide bonding pads for a semiconductor photoelectric switch element illustrated as a block 2174. Photoelectric switch element 2174 is a known element such as a PIN diode which normally has a relative high impedance between terminals but which responds to a light stimulus to assume a low impedance state. A fiber optic cable illustrated as 2172 is directed at the active region of photoelectric switch 2174 and is bonded thereto by a bonding material illustrated as 2170. The end of fiber optic cable 2172 remote from switch 2174 is connected to a photoelectric drive unit 2169 for applying light pulses through cable 2172 to photoelectric switch 2174 for periodically rendering switch 2174 conductive and thereby providing a conductive path between bridging members 2176 and 2178. A direct electric charge is generated between conductor pair 2132, 2142 and conductor pair 2134, 2144 from a source of potential illustrated by plus (+) and minus (−) symbols. The plus terminal of the source of potential is coupled through a resistor 2168 to conductor portion 2142 and by way of bridging member 2178 to conductor portion 2132. The negative (−) terminal of the source of potential is connected by way of resistor 2166 to conductor portion 2134 and by way of bridging member 2176 to conductor portion 2144. When an electric charge exists between conductor portions 2132, 2142 and conductor portions 2134, 2144, a light pulse applied over cable 2172 to photoelectric switch 2174 causes discharge of the stored energy and resulting radiation of a pulse of electromagnetic energy from antenna plate 2129. A small amount of energy is also coupled into waveguide 2112 and propagates to a waveguide termination (not illustrated). The principal purpose of the waveguide in this embodiment is as a support for the antenna plate, and is therefore not absolutely necessary. The waveguide if used may be dimensioned to be in cutoff at the frequency of the radiated pulse.

Those familiar with the art will recognize that the dielectric plate may be formed of a semiconductor material onto which the conductors are printed, and the optoelectronic switch or switches, as necessary, may be formed from the semiconductor material itself. Further, several integrated pulse generator-antennas as described may be arrayed and pulsed synchronously to generate large-amplitude radiated fields.

Figure 22:
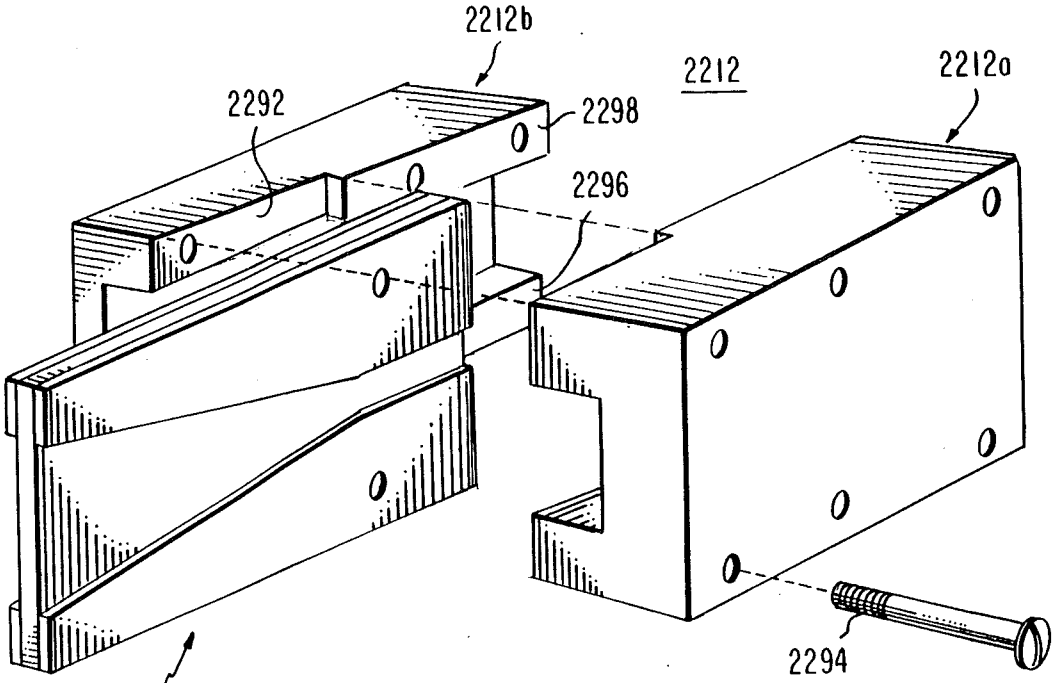
FIG. 22 is an exploded view of an embodiment of the invention in which the antenna plate is supported between two halves of a waveguide assembly.

In FIG. 22, a bilateral antenna plate 2229 is supported by being clamped between mating halves 2212*a* and 2212*b* of a waveguide section designated generally as 2212. When assembled with screws (only one of which is illustrated and designated 2294), walls 2296 and 2298 of waveguide half 2212*b* mate with corresponding walls (not visible in FIG. 22) of waveguide half 2212*a*. A wall portion 2292 set back from wall 2298 by an amount equal to slightly less than one-half the thickness of antenna plate 2229, and other similar set-back walls (not visible in FIG. 22) bear against antenna plate 2229 when assembled to thereby provide support to the antenna plate and a firm electrical connection between the conductive portions (not separately numbered) of antenna plate 2229 and conductive waveguide 2212.

Other embodiments of the invention will be apparent to those skilled in the art. In particular, the dielectric plates may have any dielectric constant. The divergence of the conductors defining the flared radiating portion of the antenna may have its origin somewhat within or without the truncation, rather than precisely at the truncation, as illustrated.

What is claimed is:

1. An antenna, comprising:

a truncated hollow conductive waveguide having a longitudinal axis, said waveguide being adapted for propagating electromagnetic energy towards a port formed by the truncation;

a dielectric plate located partially within said waveguide and having a region located partially without said waveguide at said truncation, and with the plane of said dielectric plate parallel to an electric field component of said electromagnetic energy within said waveguide;

a first conductive finline portion having a first pair of spaced conductors on one broad side of said dielectric plate defining a first longitudinal slot having a first slot axis parallel with said longitudinal axis, the width of said first longitudinal slot increasing with increasing distance from said port in said region without said waveguide to define a radiating portion having a gain;

a second conductive finline portion having a second pair of spaced conductors on a second broad side of said dielectric plate defining a second longitudinal slot having a second slot axis parallel with said longitudinal axis, the width of said second slot increasing with increasing distance from said port in said region without said waveguide for improving the performance of said radiating portion;

wherein at least said first finline is conductively isolated from said conductive waveguide, and further including electromagnetic signal generating means comprising:

charging means coupled to at least said first finline for charging said first finline to an electric potential;

controllable switch means coupled to said first finline at a location near said port for discharging said electric potential of said first finline in response to a control signal; and control signal generating means coupled to said controllable switch means for operating said controllable switch means at a time when at least said first finline is charged to an electric potential for discharging said first finline for radiating a pulse of electromagnetic energy from said radiating portion.

2. An antenna according to claim 1 wherein said dielectric plate is oriented to contain said longitudinal axis, whereby said first slot axis and second slot axis are parallel to and equidistant from said longitudinal axis.

3. An antenna according to claim 1 wherein said first and second finlines have substantially identical patterns.

4. An antenna according to claim 3 wherein said patterns of said first and second finlines are aligned and said improvement in performance is an increase in gain.

5. An antenna according to claim 1 wherein the width of said first slot in said region without said waveguide increases linearly with increasing distance from a point near said port.

6. An antenna according to claim 1 wherein the width of said first slot in said region without said waveguide increases with increasing distance from a point near said port according to an exponential law.

7. An antenna according to claim 1 wherein said waveguide is rectangular.

8. An antenna according to claim 1 wherein said dielectric plate has a dielectric constant of approximately 2.2.

9. An antenna according to claim 1 wherein said second finline is connected in parallel with said first finline with respect to said charging means and said controllable switch means whereby said first and second finlines are charged and discharged together, thereby increasing the magnitude of said pulse of electromagnetic energy.

10. An antenna, comprising:

an elongated hollow conductive waveguide truncated at a truncation and including a longitudinal waveguide axis, said waveguide supporting propagation of an electromagnetic field therein in a direction parallel with said longitudinal waveguide axis, said electromagnetic field including an electric field component orthogonal to said longitudinal waveguide axis;

a dielectric plate including first and second broad sides, said dielectric plate being located partially within said waveguide and having a region located partially without said waveguide at said truncation, said dielectric plate being oriented parallel with said electric field component within said waveguide and parallel with said longitudinal axis;

a first elongated flat conductor portion extending over a first portion of said first side of said dielectric plate, said first portion of said first side of said dielectric plate lying entirely on one side of a bisector plane perpendicular to said dielectric plate and passing through said longitudinal waveguide axis, said first elongated flat conductor portion being spaced by a predetermined amount from said bisector plane;

a second elongated flat conductor portion extending over a second portion of said second side of said dielectric plate, said second portion of said second side of said dielectric plate lying entirely on the other side of said bisector plane, said second elongated flat conductor portion being space by said predetermined amount from said bisector plane to form together with said first elongated flat conductor portion a finline transmission line defining a slot having transverse dimensions equal to twice said predetermined amount, at least the average of said predetermined amount progressively increasing with increasing distance from said truncation in said region without said waveguide to form a radiating portion;

charging means for establishing an electric charge between said first and second elongated flat conductor portions;

light-operated switch means including a controlled current path extending between said first and second elongated flat conductor portions; and means for applying a light signal to said light-operated switch for radiating a pulse of electromagnetic energy.

11. An antenna according to claim 10 wherein said predetermined amount is substantially constant over at least a region of said slot within said waveguide to define a transmission line of constant impedance within said region.

12. An antenna according to claim 10 wherein, in said region without said waveguide, said predetermined amount increase geometrically with increasing distance from said truncation.

13. An antenna according to claim 10 wherein, in said region without said waveguide, said predetermined amount increases in proportion to the distance from said truncation.

14. An antenna according to claim 10 further comprising:

at least a third elongated flat conductor portion extending over a second portion of said first side of said dielectric plate, said second portion of said first side lying entirely on said other side of said bisector plane, said third elongated flat conductor portion being spaced by a second predetermined amount from said bisector plane.

15. An antenna according to claim 14 wherein said second predetermined amount equals said first predetermined amount, whereby said first and third elongated flat conductor portions are aligned.

16. An antenna according to claim 10 wherein said longitudinal waveguide axis lies within said dielectric plate.

17. An antenna according to claim 10 further comprising a second dielectric plate parallel to and contiguous with the sides of said first and second elongated flat conductor portions remote from said first dielectric plate.

18. An antenna according to claim 10, wherein said predetermined amount includes periodic variations as a function of said distance from said truncation, whereby said slot defines serrations in said radiating portion.

* * * * *